US005780388A

United States Patent [19]

Wada et al.

[11] Patent Number: 5,780,388

[45] Date of Patent: Jul. 14, 1998

[54] HEAT SENSITIVE RECORDING MATERIAL

[75] Inventors: Minoru Wada; Kotaro Nakamura, both of Shizuoka-ken, Japan

[73] Assignee: Fuji Photo Film Co., Ltd., Kanagawa, Japan

[21] Appl. No.: 748,839

[22] Filed: Nov. 14, 1996

[30] Foreign Application Priority Data

Nov. 16, 1995 [JP] Japan ..... 7-298160

[51] Int. Cl.[6] ..... B41M 5/40

[52] U.S. Cl. ..... 503/226; 427/152; 503/200

[58] Field of Search ..... 427/152; 503/200, 503/226, 216, 217, 221

[56] References Cited

FOREIGN PATENT DOCUMENTS 63-45084 2/1988 Japan ..... 503/226

*Primary Examiner*—Bruce H. Hess

*Attorney, Agent, or Firm*—Sughrue, Mion, Zinn, Macpeak & Seas, PLLC

[57] ABSTRACT

The heat sensitive recording material of the present invention has, between a support and a heat sensitive recording layer, an intermediate layer having a tensile modulus of elasticity of from $1\times10^8$ to $1\times10^{10}$ dyne/cm$^2$) as measured according to JIS K 7127. The heat sensitive recording material of the present invention is suitable to prevention of abrasion of a thermal head and prevention of sticking of the heat sensitive recording material to the thermal head.

14 Claims, 2 Drawing Sheets

Fig. 2 Tensile Stress-Strain Curve
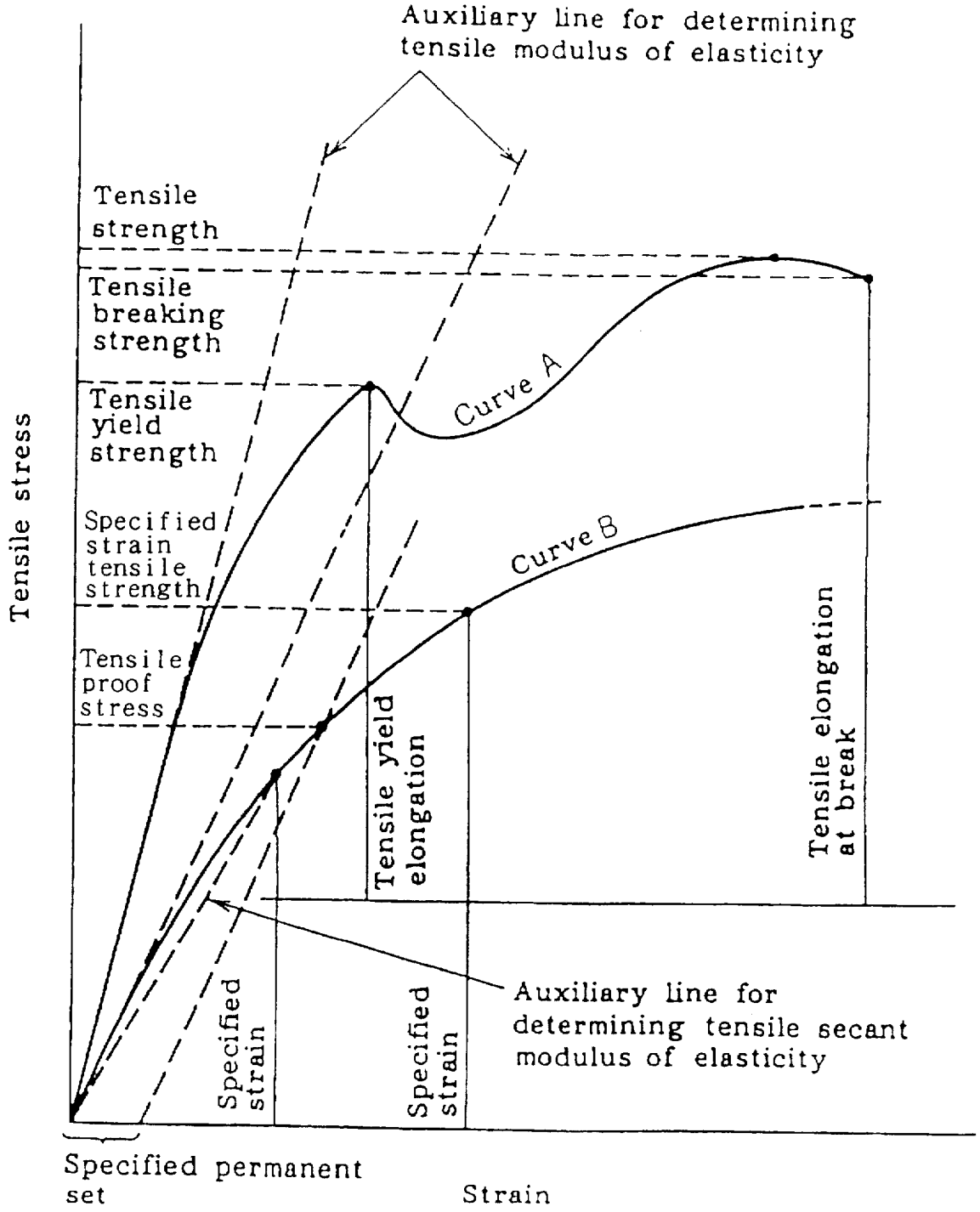

HEAT SENSITIVE RECORDING MATERIAL

BACKGROUND OF THE INVENTION

1. Field of the Invention

The present invention concerns a heat sensitive recording material and, more in particular, it relates to a heat sensitive recording material capable of preventing degradation of the working life of a thermal head caused by disconnection of resistor elements due to abrasion of the thermal head and eliminating contamination of the thermal head caused by sticking of the heat sensitive recording layer to the thermal head, and suitable to stable heat sensitive recording.

2. Description of the Related Art

Since a heat sensitive recording method has various advantages, for example, such that (1) development is not required, (2) the material of a support, if it is made of paper, is similar to that of common paper, (3) handling is easy, (4) a color forming density is high, (5) a recording device is simple in the structure and inexpensive and (6) recording operation is noiseless, application use of the heat sensitive recording method has been generalized more, for example, in the field of facsimiles or printers and in the field of POS labels, etc. Therefore, requirements to heat sensitive recording materials have been varied, more, and heat sensitive recording materials capable of multi-color recording and transparent materials for use in over-head projector have been developed (refer, for example, to Japanese Patent Application Laid-Open (JP-A) No. 63-45084).

Further, along with the recent trend of making various functions electronic in medical equipments such as supersonic scanners, CT scanners and X-ray apparatus, transparent heat sensitive recording materials capable of directly recording digital images from such equipments have also been developed. Generally, upon physicians' diagnosis, a light, for example, from a fluorescent lamp is applied at the back of images recorded on the heat sensitive recording material (such a device for applying light is referred to as a light box) and images are observed on the side of a support so as not to injure them.

By the way, heat sensitive recording is conducted to a heat sensitive recording material at a predetermined recording energy while causing the heat sensitive recording material to run between a thermal head and a platen roll with the heat sensitive recording layer of the heat sensitive recording material being opposed to the thermal head. However, a certain rigidity is required in view of handling for the heat sensitive recording material of this type. However, when heat sensitive recording is conducted by using the heat sensitive recording material, resistor elements are liable to be disconnected by the abrasion of the thermal head to result in a problem of shortening the life of the thermal head and, further, the thermal head is contaminated due to sticking of the heat sensitive recording layer to the thermal head to bring about a problem that no stable heat sensitive recording can be conducted.

It is, accordingly, an object of the present invention to provide a heat sensitive recording material capable of preventing disconnection of resistor elements caused by the abrasion of a thermal head, and extending the working life of the thermal head, and eliminating contamination to the thermal head due to sticking of the heat sensitive recording layer to the thermal head, thereby conducting stable heat sensitive recording.

SUMMARY OF THE INVENTION

The foregoing object of the present invention can be attained by a heat sensitive recording material having a heat sensitive recording layer disposed on a support, wherein an intermediate layer having a tensile modulus of elasticity as measured in accordance with JIS K 7127 of from $1\times10^8$ to $1\times10^{10}$ dyne/cm$^2$) is disposed between the support and the heat sensitive recording layer.

BRIEF DESCRIPTION OF THE DRAWING

More specifically, FIG. 1 is a graph illustrating a relationship between a head pressure and a head position (μm) of a thermal head in the following two cases; namely, when polyethylene terephthalate (PET) film of 125 μm thickness and having a tensile modulus of elasticity of $2\times10^{10}$ dyne/cm$^2$ is used as a support, on which polyethylene having a tensile modulus of elasticity of $2\times10^9$ dyne/cm$^2$ (symbol "+" means polyethylene of 40 μm thickness and symbol "◇" means polyethylene of 50 μm thickness) is melt-extruded to form an intermediate layer and a heat sensitive recording layer of 15 μm is formed thereover, and when a polyethylene terephthalate (PET) film of 175 μm thickness and having a tensile modulus of elasticity of $2\times10^{10}$ dyne/cm$^2$ is used as a support, on which a heat sensitive recording layer of 15 μm thickness is formed directly thereon without forming the intermediate layer.

FIG. 2 is a graph illustrating of tensile stress-strain curve.

DESCRIPTION OF THE PREFERRED EMBODIMENTS

Figure 1:
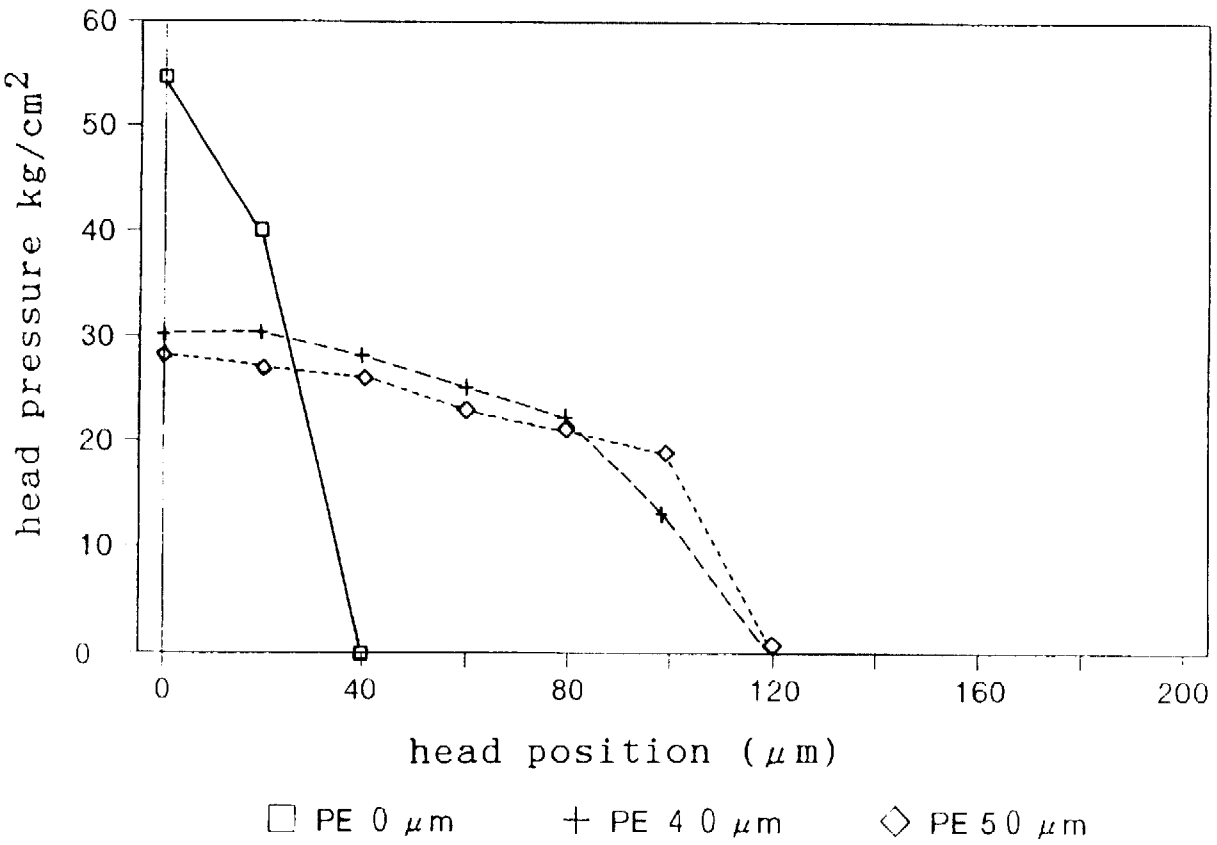
FIG. 1 is a graph illustrating a relationship between a head pressure and a head position with or without an intermediate layer on a support.

The support in the present invention can include, for example, those resins such as polyethylene terephthalate, polyethylene naphthalate, polybutylene terephthalate, cellulose triacetate, polypropylene, polystyrene, polyethylene, polyvinylidene chloride, polyacrylate, and polycarbonate. As the form of the support, there can be mentioned a resin film using the resin described above.

The support is preferably transparent, and it may be colorless transparent or colored transparent by coloration depending on the application use and the purpose of the heat sensitive recording material.

The method of coloring the support includes, for instance, (1) a method of forming a film by kneading, for example, a blue dye in the resin before forming a film, (2) a method of preparing a coating solution, for example, containing a blue dye on a colorless transparent film of the resin, and coating and drying the same by a known coating method, for example, a gravure coating method, a roller coating method or a wire coating method. Further, in the present invention, (3) a method of kneading, for example, a blue dye into an intermediate layer to be described later thereby coloring the intermediate layer may also be adopted. Among them, the method (1) is preferred and, particularly preferably, a polyester resin such as polyethylene terephthalate or polyethylene naphthalate is kneaded with a blue dye, formed into a film and applied, for example, with a heat resistant treatment, stretching treatment or antistatic treatment.

There is no particular restriction for the thickness of the support but it is usually from 25 to 300 μm and, preferably, from 50 to 200 μm.

There is no particular restriction on the dye used for the coloration and, dyes used for X-ray photographic film supports colored to blue or purple blue are generally preferred. Such dyes included, for example, those as described in Japanese Patent Application Publications (JP-B) Nos.

47-8734, 47-30294 and 51-25335. The dye may be used alone, or two or more of them may be mixed and used together.

Further, in the present invention, when the intermediate layer has a tensile modulus of elasticity described later, rigidity and the maximum recording permeation density (greater than or equal to 2.0) to some extent of the heat sensitive recording material required for the transparent heat sensitive recording material capable of directly recording digital images of medical equipments such as supersonic scanners, CT scanners and X-ray apparatus by the support and there is no trouble in the handling of the heat sensitive recording material having images formed thereon. Considering this, it is preferred that the support has a tensile modulus of elasticity greater than that of the intermediate layer to be described later.

In the present invention, the following intermediate layer is coated and formed on the support.

The intermediate layer has a tensile modulus of elasticity as measured according to JIS K 7127 of from $1\times10^8$ dyne/cm$^2$ to $1\times10^{10}$ dyne/cm$^2$.

JIS (Japanese Industrial standard) K 7127 specifies the general tensile testing method of plastic films and sheets of 1 mm and under in thickness. However, this Standard does not apply to fibre reinforced plastic films and sheets, and to foamed plastic films and sheets.

The tensile modulus of elasticity as measured according to JIS K 7127 means that the ratio of the tensile stress to the strain corresponding thereto within the tensile limit of proportionality. When the tensile stress-stress curve has no linear portion, the modulus of elasticity shall be determined by the inclination of a tangent at the initiation point of plastic deformation.

The calculator of the tensile modulus of elasticity shall be as follows:

(1) Tensile yield strength, tensile strength, tensile breaking strength, or specified strain tensile strength shall be calculated according to the following equation.

$$\sigma = \frac{F}{A}$$

where

σ: tensile yield strength, tensile strength, tensile breaking strength or specified stress tensile strength (N/mm$^2$) (kgf/mm$^2$)

F: load at yield, the maximum load, breaking or specified stress (N)(kgf)

A: initial minimum section area of test piece (mm$^2$)

(2) Tensile yield elongation, tensile elongation at break, or elongation at the maximum tensile load shall be calculated according to the following equation.

$$\epsilon = \frac{L - L_0}{L_0} \times 100$$

where

Σ: tensile yield elongation, tensile elongation at break or elongation at the maximum tensile load (%)

L: gauge length at yield, fracture or the maximum load (mm)

$L_0$: initial gauge length (mm)

(3) Tensile modulus of elasticity shall be calculated according to the following equation by using the initial linear portion of tensile stress-strain curve (see FIG. 2)

$$Em = \frac{\Delta\sigma}{\Delta\delta}$$

where

Em : tensile modulus of elasticity (N/mm$^2$)(kgf/mm$^2$)

Δσ: difference between stresses calculated by the initial section area at two points on the linear portion of the stress-strain curve (N/mm$^2$)(kgf/mm$^2$)

Δδ: difference between strains at the above two points

If the tensile modulus of elasticity of the intermediate layer is not less than $1\times10^{10}$ dyne/cm$^2$, a head pressure of the heat sensitive recording layer formed on the intermediate layer to the thermal head is increased tending to cause abrasion of the head and shorten the life of the thermal head. On the other hand, if the tensile modulus of elasticity of the intermediate layer is not more than $1\times10^8$ dyne/cm$^2$, the head pressure of the heat sensitive recording layer formed on the intermediate layer to the thermal head is low and no intended images can be obtained, particularly, in a case of a heat sensitive recording material having high permeation recording density.

The tensile modulus of elasticity shows a ratio between a tensile stress and a corresponding strain within a proportional limit of tension and it depends on a gradient of a tangential line at an initiation point for deformation.

The material for the intermediate layer can include suitably, for example, polyolefin resins such as polyresin, a homopolymer or copolymer of α olefin such as polyethylene and polypropylene is preferred. Further, as the polyethylene, a high density polyethylene, a low density polyethylene or a mixture thereof is preferred.

The intermediate layer is preferably coated and formed on the support by melt-extrusion coating. In this case, the material for the intermediate layer can be selected properly among the polyolefin resins described above, so long as melt extrusion coating is adaptable, and a polyolefinic resin having a molecular weight about from $10^4$ to $10^6$ is particularly preferred.

When the intermediate layer is coated and formed, it is preferred that an activating treatment is applied to the surface of the support. Further, for improving adhesion, for example, with the heat sensitive recording layer to be described later, it is preferred to apply the activating treatment also to the surface of the intermediate layer. As the activating treatment, corona discharge or the like can be mentioned particularly preferably.

The thickness of the intermediate layer is preferably from 10 to 100 μm within a range capable of satisfying the tensile modulus of elasticity.

In a case of a heat sensitive recording material not provided with the intermediate layer as described above (shown by symbol "□" in FIG. 1), a head pressure is high as shown in FIG. 1, tending to cause abrasion of the head. On the other hand, in a case of a heat sensitive recording material of the present invention provided with the intermediate layer as described above (shown by symbol "+" or "◇" in FIG. 1, a head pressure is low within a relatively wide range of the head position and abrasion of the head is less caused.

In the present invention, a heat sensitive recording layer to be describe later is coated and formed on the intermediate layer described above.

The heat sensitive recording layer at least contains a color coupler and a color developer. In the heat sensitive recording layer, the color coupler and the color developer isolated from each other at a normal temperature are brought into contact with each other by heating to develop a color thereby recording images.

Each of the color coupler and the color developer is an ingredient which is substantially colorless before color formation but takes place a color forming reaction when brought into contact with each other. As a combination of the color coupler and the color developer, a combination of an electron donating dye precursor (color coupler) and an acidic substance (color developer), or a combination of a diazo compound (color coupler) and a coupling compound (color developer) is preferred. Among them, the former combination is particularly preferred with a view point of image clarity.

There is no particular restriction on the electron donating dye precursor (color coupler) used in the present invention so long as the material is substantially colorless. A substantially colorless compound that donates electrons or accepts protons such as of an acid to form a color, has a partial skeleton of lacton, lactam, sulton, spiropyran, ester and amide and in which the partial skeleton is put to ring opening or splitting upon contact with the color developer is preferred.

The compound (color coupler) described above can include various compounds such as triphenyl methane phthalide compound, indolyl phthalide compound, fluoran compound, phenothiazine compound, leucoaulamine compound, rhodamine lactam compound, triphenylmethane compound, triazene compound, spiropyrane compound, and fluorene compound. Examples of the phthalides are described, for example, in U.S. reissue Patent specification No. 23024, U.S. Patent Specifications Nos. 3491111, 3491112, 3491116 and 3509174. Examples of the fluorans are described, for example, in U.S. Patent Specifications Nos. 3624107, 3627787, 3641011, 3462828, 3681390, 3920510 and 3959571. Examples of spirodipyranes are described, for example, in U.S. Patent specification No. 3971808. Pyridine and pyradine compounds are described, for example, in U.S. Patent Specifications Nos. 3775424, 3853869 and 4246318. Examples of the fluorene compounds are described, for example, in Japanese Patent Application Sho 61-240989.

In the present invention, black color forming 2-aryl, amino 3-(H, halogen, alkyl or alkoxy)-6-substituted aminofluorans are particularly preferred. Examples of them can include, for example, 2-anilino-3-methyl-6-diethyl aminofluoran,
2-anilino-3-methyl-6-N-ethyl-N-butyl-aminofluoran,
2-anilino-3-methyl-6-N-cyclohexyl-N-methylaminofluoran,
2-p-chloroanilino-3-methyl-6-dibutylaminofluoran,
2-anilino-3-methyl-6-dioctylaminofluoran,
2-anilino-3-chloro-6-diethylamino fluoran,
2-anilino-3-methyl-6-N-ethyl-N-isoamylaminofluoran,
2-anilino-3-methyl-6-N-ethyl-N-dodecylaminofluoran,
2-anilino-3-methoxy-6-dibutylaminofluoran,
2-o-chloroanilino-6-dibutylamino fluoran,
2-p-chloroanilino-3-ethyl-6-N-ethyl-N-isoamylamino fluoran,
2-o-chloroanilino-6-p-butylanilino fluoran,
2-anilino-3-pentadecyl-6-diethylamino fluoran,
2-anilino-3-ethyl-6-dibutylamino fluoran,
2-o-toluidino-3-methyl-6-diisopropylamino fluoran,
2-anilino-3-methyl-6-N-isobutyl-N-ethylamino fluoran,
2-anilino-3-metbyl-6-N-ethyl-N-tetradhydrofurfurylamino fluoran,
2-anilino-3-chloro-6-N-ethyl-N-isoamylamino fluoran,
2-anilino-3-methyl-6-N-methyl-N-γ-ethoxypropylamino fluoran,
2-anilino-3-methyl-6-N-ethyl-N-γ-ethoxypropylamino fluoran and
2-anilino-3-methyl-6-N-ethyl-N-γ-propoxypropyjamino fluoran.

The color developer used in combination with the compound described above (color coupler) can include, for example, acidic materials such as phenol compounds, organic acids or metal salts thereof and oxybenzoate esters.

Examples of them are described, for example, in Japanese Patent Application Laid-Open (JP-A) No. 61-291183.

The color developer can include, for example, bisphenols such as, 2, 2-bis(4'-hydroxyphenyl)propane (common name bisphenol A),
2,2-bis(4'-hydroxyphenyl)pentane,
2,2-bis(4'-hydroxy-3',5'-dichlorophenyl)propane,
1,1-bis(4'-hydroxyphenyl)cyclohexane,
2,2-bis(4'-hydroxyphenyl)hexane,
1,1-bis(4'-hydroxyphenyl)propane,
1,1-bis(4'-hydroxyphenyl)butane,
1,1-bis(4'-hydroxyphenyl)pentane,
1,1-bis(4'-hydroxyphenyl)hexane,
1,1-bis(4'-hydroxyphenyl)heptane,
1,1-bis(4'-hydroxyphenyl)octane,
1,1-bis(4'-hydroxyphenyl)-2-methyl-pentane,
1,1-bis(4'-hydorxyphenyl)-2-ethyl-hexane,
1,1-bis(4'-hydroxyphenyl)dodecane,
1,4-bis(p-hydroxyphenylcumyl)benzene,
1,3-bis(p-hydroxyphenylcumyl)benzene,
bis(p-hydroxyphenyl)sulfone,
bis(3-allyl-4-hydroxyphenyl)sulphone, and
bis(p-hydroxyphenyl)benzyl acetate;

salicylic acid derivatives such as 3,5-di-α-methyl benzyl salicylic acid,
3,5-di-tertiary butyl salicylic acid,
3-α-α-dimethyl benzyl salicylic acid,
4-(β-p-methoxyphenoxyethoxy)salicylic acid, or polyvalent metal salts thereof (zinc or aluminum being particularly preferred); and oxybenzoate such as benzyl p-hydroxybenzoate, 2-ethylhexyl p-hydroxybenzoate, and
(2-phenoxyethyl) β-resorcinate, and phenols such as p-phenyl phenol, 3,5-diphenylphenol, cumylphenol, 4-hydroxy-4'-isopropoxy-diphenylsulfone and 4-hydroxy-4'-phenoxydiphenylsulfone.

The color developers may be used alone or two or more of them may be used in combination.

In the present invention, among the color developers described above, bisphenols are preferred for the purpose of improving the color forming property.

The amount of the color developer used is preferably from 50 to 800% by weight and, more preferably, from 100 to 500% by weight based on the color coupler.

The diazo compound (color coupler) used in the present invention is a photolyzable diazo compound that reacts with a coupling compound to be described later (color developer) to form a color at a desired hue but is decomposed if undergoing light at a predetermined wavelength before reaction and no more possesses color forming ability even if the coupling agent (color developer) is actuated.

The hue of the color forming system with the diazo compound (color coupler) and the coupling compound (color developer) described above is determined by a diazo dye formed upon reaction of the diazo compound (color coupler and the coupling compound (color developer). Accordingly, as is well-known, the hue can be changed easily by changing the chemical structure of the diazo compound (color coupler), or by changing the chemical structure of the coupling compound (color developer), and an optional hue can be obtained depending on the combination of the diazo compound (color coupler) and the coupling compound (color developer).

The photolyzable diazo compound in the present invention mainly means aromatic diazo compounds and, more specifically, aromatic diazonium salts, diazosulfonate compounds and diazoamino compounds.

The aromatic diazonium salt is a compound represented by the general formula: $ArN_2^+X^-$. In the general formula, Ar represents a substituted or not-substituted aromatic moiety. $N_2^+$ represents a diazonium group. $X^-$ represents an acid anion.

Various kinds of diazosulphonate compounds have been known and can be obtained by treating corresponding diazonium salts with a sulfite salt.

The diazo amino compound can be obtained by coupling the diazo group with dicyan diamide, sarcosine, methyl taurine, N-ethyl anthranilic acid-5-sulfonic acid, monoethanol amine, diethanol amine and guanidine.

Details for the photolyzable diazo compounds are described, for example, in Japanese Patent Application Laid-Open (JP-A) No. 2-136286.

The coupling ingredient for coupling and reacting with the diazo compound used in the present invention can include, for example, 2-hydroxy-3-naphthoic acid anilide, as well as those described in Japanese Patent Application Laid-Open (JP-A) No. 62-146678 including resorcin.

In a case of adopting a combination of the diazo compound (color coupler) and the coupling compound (color developer) in the present invention, a basic substance may be added to the color forming reaction system for promoting the coupling reaction.

As the basic substance, a water insoluble or less soluble basic substance or a substance forming an alkali by heating is used. Examples of them can include, for example, nitrogen-containing compounds such as organic and inorganic ammonium salts, organic amines and amide, urea, thiourea and derivatives thereof, thiazoles, pyrrols, pyrimidines, piperazines, guanidines, indoles, imidazoles, imidazolines, triazols, morpholines, piperidines, amidines, formamizines and pyridines. Examples of them are described, for example, in Japanese Patent Application Laid-Open (JP-A) No. 61-291183. The basic substances may be used alone or two or more of them may be used in combination.

In the present invention, the color coupler or the color developer may be used by solid dispersion into a heat sensitive recording layer by a known method, but it may be used preferably by microencapsulation with view points of improving the transparency of the heat sensitive recording layer, shelf-life by preventing contact between the color coupler and the color developer at a normal temperature (inhibition of fogging) and control for the color forming sensitivity of forming color at a desired heat energy.

For the manufacture of the microcapsules, any of interface polymerization, internal polymerization or external polymerization processes may be adopted. It is particularly preferred to adopt the interface polymerization process of emulsifying a core substance containing an electron donating colorless dye, diazonium salt or the like in an aqueous solution containing a water soluble compound dissolved therein and forming walls of high molecular substance (capsule wall) at the periphery of oil droplets thereof.

Reactants forming the high molecular weight substance are added to the inside of the oil droplet and/or outside of the oil droplet. Examples of the high molecular weight substance can include, for example, polyurethane, polyurea, polyamide, polyester, polycarbonate, urea-formaldehyde resin, melamine resin, polystyrene, styrene methacrylate copolymer and styrene acrylate copolymer. Among them, polyurethane, polyurea, polyamide, polyester, polycarbonate and the like are preferred, polyurethane and polyurea being particularly preferred. The high molecular weight substances may be used alone or two or more of them may be used in combination.

Examples of the water soluble compound can include, for example, gelatin, polyvinyl pyrrolidone and polyvinyl alcohol.

In a case in which the capsule wall is made of a material, for example, polyurea, the capsule wall can be formed easily by reacting a polyisocyanate such as diisocyanate, triisocyanate, tetraisocyanate or polyisocyanate prepolymer with a polyamine such as diamine, triamine or tetramine, a prepolymer containing two or more amino groups, piperazine or a derivative thereof or a polyol in an aqueous solvent by the interface polymerization process.

In a case in which the capsule wall is made of a material comprising polyurea and polyamide, or a material comprising polyurethane and polyamide, the capsule wall can be formed by using a polyisocyanate and an acid chloride, or a polyamine and a polyol, and heating them after adjusting the pH of an emulsion medium as a reaction solution. In a case in which the capsule wall is made of a material comprising a polyurea and a polyamide, details for the production process are described, for example, in Japanese Patent Application Laid-Open (JP-A) No. 58-66948.

If necessary, a metal-containing dye, a charge controller such as nigrosine or other optional additives may be added as required to the capsule wall. The additives can be incorporated into the capsule wall upon forming the capsule walls or at an optional timing. Further, a monomer such as a vinyl monomer may be graft-polymerized as required to the surface of the capsule wall for adjusting the charging property at the surface of the capsule wall.

In the present invention, a plasticizer can be used for rendering the capsule wall of the microcapsule to permeate substance at a lower temperature. Any of plasticizers that is adaptable to the high molecular weight substance as the material for the capsule wall, has a melting point preferably from 50° to 120° C. and is present as a solid at a normal temperature can be selected properly. When the capsule wall is made of polyurea or polyurethane, examples of the plasticizer can include, preferably, hydroxy compound, carbamate compound, aryl alkoxy compound, organic sulfone amide compound, aliphatic amide compound and aryl amide compound.

Further, in the present invention, it is preferred to microencapsule the color coupler, as well as form the color developer into an emulsified dispersion with a view point of improving the storability of the heat sensitive recording material.

In the present invention, the color developer can be used as a solid dispersion but, with a view point of improving the transparency of the heat sensitive recording layer and making the light permeability of the heat sensitive material satisfactory, it is particularly preferred to use the color developer as an emulsified dispersion by dissolving the color developer into a water less soluble or insoluble organic solvent, mixing the solution with an aqueous phase containing water soluble high molecular weight material containing a surface active agent as a protective colloide and emulsifying and dispersing the same.

The organic solvent used for the emulsifying dispersion can be selected properly from oils having high boiling points. Among them, preferred oils are esters, as well as dimethyl naphthalene, diethylnaphthalene, diisopropylnaphthalene, dimethyl biphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane and triallylmethane (for example, tritoluylmethane and toluyldiphenyl methane), terphenyl compound (for example terphenyl), alkyl compound, alkylated diphenyl ether (for example, propyldiphenyl ether), hydrogenated terphenyl (for example, hexahydroterphenyl) and diphenyl ether. Esters are particularly preferred with a view point of the emulsion stability of the emulsified dispersion.

The esters described above can include, for example, phosphates (for example, triphenyl phosphate, tricresyl phosphate, butyl phosphate, octyl phosphate and cresylphenyl phosphate), phthalates (dibutyl phthalate, 2-ethyl-hexyl phthalate, ethylphthalate, octyl phthalate and butyl benzyl phthalate), dioctyl tetrahydrophthalate, benzoates (ethyl benzoate, propylbenzoate, butyl benzoate, isopentyl benzoate and benzyl benzoate), abietates (ethyl abietate and benzyl abietate), dioctyl adipate, isodecyl succinate, dioctyl azelate, oxalates (dibutyl oxalate and dipentyl oxalate, diethyl maronate, maleates (dimethyl maleate, diethyl maleate and dibutyl maleate), tributyl citrate, sorbates (methyl sorbate, ethyl sorbate and butyl sorbate), sebacates (dibutyl sebacate and dioctyl sebacate), ethylene glycol esters (monoester or diester of formic acid, monoester or diester of butyric acid, monoester or diester of lauric acid, monoester or diester of palmitic acid and monoester or diester of stearic acid, monoester or diester of oleic acid), triacetin, diethyl carbonate, diphenyl carbonate, ethylene carbonate, propylene carbonate, borates (tributyl borate and tripentyl borate). Among them, it is particularly preferred to use tricresyl phosphate alone or in admixture, with a view point that the stability of the emulsification product is most excellent. They may be used alone or two or more of them may be used in combination.

In the present invention, an auxiliary solvent may be added further as a low boiling point dissolving aid to the organic solvent described above. Particularly preferred auxiliary solvent can include, for example, ethyl acetate, isopropyl acetate, butyl acetate and methylene chloride.

The water soluble compound incorporated as the protective colloid in an aqueous phase to be mixed with an oil phase containing the ingredients described above, can be selected properly, for example, from known anionic, nonionic and amphoteric high molecular weight materials. Among them, polyvinyl alcohol, gelatin and cellulose derivative are particularly preferred.

Further, as the surface active agent incorporated in the aqueous phase, anionic or nonionic surface active agents that cause neither precipitation nor coagulation by interaction with the protective colloid can be selected properly. Among them, sodium alkyl benzene sulfonate, sodium alkyl sulfate, sodium salt of dioctyl sulfosuccinate and polyalkylene glycol (for example, polyoxyethylene nonylphenyl ether) are preferred.

The emulsified dispersion in the present invention can be obtained easily by mixing and dispersing the oil phase containing the ingredients described above and the aqueous phase containing the protective colloid and the surface active agent by using usual means employed for emulsification of fine particles, such as high speed stirring or supersonic wave dispersion.

The weight ratio between the oil phase and the aqueous phase (oil phase weight/aqueous phase weight) is preferably, from 0.02 to 0.6 and, particularly preferably, from 0.1 to 0.4. If the ratio is not more than 0.02, the aqueous phase is excessive to make the solution lean, failing to obtain a sufficient color forming property. On the other hand, if the ratio exceeds 0.6, the viscosity of the solution is increased to bring about inconvenience for the handling and lowering of the stability of the coating solution.

When the solution of the heat sensitive recording layer prepared as described above is coated on a support, any known coating means using a coating solution of an aqueous or organic solvent system is used. In this case, methyl cellulose, carboxymethyl cellulose, hydroxyethyl cellulose, starch, gelatin, polyvinyl alcohol, carboxyl-modified polyvinyl alcohol, polyacryl amide, polystyrene and copolymer thereof, polyester and copolymer thereof, polyethylene and copolymer thereof, epoxy resin, acrylate and methacrylate resin and copolymer thereof, polyurethane resin, and polyamide resin can be used together with microcapsules in the present invention for coating the solution of the heat sensitive recording layer safely and uniformly and maintaining the strength of the coating film.

If necessary, pigment, wax, film hardener or the like may be added to the heat sensitive recording layer.

The heat sensitive recording layer is coated preferably such that the entire amount of the color coupler and the color developer is from 0.1 to 10 g/m$^2$. The thickness of the heat sensitive recording layer is preferably from 1 to 20 μm.

In the present invention, with an aim of preventing the heat sensitive recording layer from peeling off the support, a primer layer is preferably disposed on the support or on the intermediate layer before coating the heat sensitive recording layer containing microcapsules, etc.

As the primer layer, acrylate copolymer, polyvinylidene chloride, SBR, aqueous polyester and the like can be used. The thickness of the primer layer is preferably from 0.1 to 0.5 μm.

When the heat sensitive recording layer may be sometimes coated on the primer layer, since the primer layer is swollen with the water content in the heat sensitive recording layer to worsen the images recorded in the heat sensitive recording layer, it is preferred to harden the layer by using a film hardener, for example, dialdehydes such as glutar aldehyde and 2,3-dihydroxy-1,4-dioxane, and boric acids. The addition amount of the film hardener can be properly selected to an optimal addition amount within a range from 0.20 to 3.0% by weight in accordance with the weight of the primer layer depending on a desired degree of hardening.

In the present invention, a protection layer is disposed preferably by a known method on the heat sensitive recording layer in order to prevent the lowering of apparent transparency caused by light scattering on the surface of the heat sensitive recording layer. Details for the protection layer are described, for example, in "Paper Pulp Technology Times" (September, 1985), 2–4 p. and Japanese Patent Application Laid-Open (JP-A) No. 63-318546.

With a view point of improving the transparency of the protection layer, the protection layer can be formed, particularly preferably, by using completely saponified polyvinyl alcohol, carboxy-modified polyvinyl alcohol or silica modified polyvinyl alcohol. The protection layer may contain, for example, known film hardener, wax and pigment. In the present invention, a protection layer comprising a silicone resin as the main ingredient may be disposed together with or in place of the above-mentioned protection layer used so far. This improves the water proofness without deteriorating the transparency of the heat sensitive recording layer.

The heat sensitive recording layer, the protection layer and the primer layer are coated and formed by a known coating method such as a blade coating method, air knife coating method, gravure coating method, roll coating method, spray coating method, dip coating method or bar coating method.

According to the present invention, the rigidity and the like required for the heat sensitive recording material can be maintained by the support, and the abrasion of the thermal head can be prevented and the sticking of the heat sensitive recording layer to the thermal head can be prevented by the provision of the intermediate layer having the specified tensile of modulus of elasticity described above, and images can be formed stably for a long period of time.

The present invention will be explained more concretely with reference to examples but the invention is not restricted only to the following examples. In the following examples, all concentration mean "% by weight".

EXAMPLE 1

Preparation of capsule solution

To a solvent mixture comprising 20 g of ethyl acetate and 5 g of methylene chloride, 16 g of 2-anilino-3-methyl-6-N-ethyl-N-butyl-aminofluoran as a color coupler and 10 g of TAKENATE D-110N (Trade name of products of capsule wall agent manufactured by Takeda Yakuhin Industry Co.) were added and dissolved. After mixing the resultant solution with an aqueous phase comprising 400 g of an aqueous 8 wt % solution of polyvinyl alcohol, 15 g of water and 0.5 g of an aqueous 2 wt % solution of sodium salt of dioctyl sulfosuccinate (surface active agent) as a mixture, they were emulsified for 5 min at 1000 rpm by using an Ace Homogenizer (manufactured by Nippon Seiki. Co.). After adding 70 g of water further to the resultant liquid emulsion, capsulating reaction was conducted at 40° C. for 3 hours to prepare a solution containing microcapsules having an average grain size of 0.7 μm. The average grain size of the microcapsules was expressed by the value of 50% volume average grain size as measured by using a laser diffraction grain size distribution measuring device manufactured by Kabushiki Kaisha Horiba Seisakusho.

Preparation of emulsified dispersion of color developer

The color developer represented by the following structural formula (1) in an amount of 4 g:

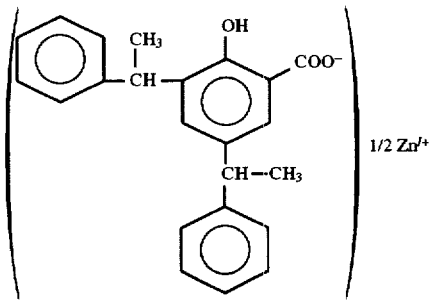

(1)

in the color developer represented by the structural formula (2) in an amount of 2 g,

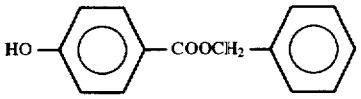

(2)

and the color developer represented by the following structural formula (3) in an amount of 15 g

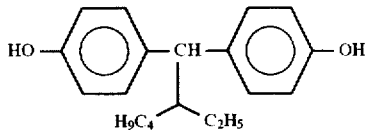

(3)

were added to and dissolved in a solvent mixture comprising 4 g of 1-phenyl-1-xylylethan and 15 g of ethyl acetate. After mixing the resultant solution with as aqueous phase prepared by mixing 40 g of an aqueous 8 wt % solution of polyvinyl alcohol and 0.5 g of sodium dodecyl benzene sulfonate, they were emulsified by using Ace Homogenizer (manufactured by Nippon Seiki Co.) at 10,000 rpm such that the average grain size was 0.5 μm.

Preparation of protection layer solution

After mixing 20 g of an aqueous 10 wt % solution of carboxyl modified polyvinyl alcohol (KM 618 manufactured by Krarey Co.,) with addition of 30 g of waer and 0.3 g of an aqueous 2 wt % solution of sodium salt of diotyl sulfosuccinate, with 100 g of 3 wt % polyvinyl alcohol (PVA 205 manufactured by Krarey Co.) and 35 g of Kaolin previously, 3 g of kaolinite liquid dispersion obtained by dispersing in a ball mill and 0.5 g of a 30 wt % liquid dispersion of zinc stearate (Z-7-30, manufactured by Chukyo Yushi Co.) were mixed to prepare a protection liquid.

Manufacture of heat sensitive recording material

After applying corona discharging treatment to the surface of a polyethylene terephthalate (PET) film as a support having 125 μm thickness and tensile modulus of elasticity of $4\times10^{10}$ dyne/cm$^2$, an intermediate layer comprising polyethylene having a tensile modulus of elasticity of $2\times10^9$ dyne/cm$^2$ was coated and formed on the support to a thickness of 50 μm by using a melting extruder. Subsequently, corona discharging treatment was applied to the surface of the intermediate layer.

A liquid formed by mixing under stirring 5.0 g of the capsule solution, 10.0 g of the emulsified liquid dispersion of the color developer and 5 g of water was coated and dried on the surface of the intermediate layer so as to contain 15 g/m$^2$ of solid content, to form a heat sensitive recording layer. Then, the protection layer solution was coated and dried to a dry thickness of 2 μm on the thus formed heat sensitive recording layer to manufacture a transparent heat sensitive recording material according to the present invention.

The thus obtained heat sensitive recording material of 257 mm width was passed between a thermal head: KGT-260-12 MP8-FF (Trade Name of products manufactured by Kyocera Co.) and a platen roll (iron core diameter: 28 mm, rubber diameter 36 mm: rubber hardness: 70 degree, length: 257 mm, roll pressure: 7 kg) such that the heat sensitive recording layer of the heat sensitive recording material opposed to the thermal head and a recording running test was conducted at a recording energy of 100 mJ/mm$^2$ and a running speed of 5.5 mm/s. As a result, non-recorded area was formed when the running distance of the heat sensitive recording material exceeded 5 km, which is supposed to be attributable to the disconnection of thermal head resistor elements.

EXAMPLE 2

A heat sensitive recording material was manufactured and a running test was conducted for the heat sensitive recording material in the same manner as in Example 1 except for using polyethylene having a tensile modulus of elasticity of $9\times10^9$ dyne/cm$^2$ for the intermediate layer. As a result, non-recorded area was formed when the running distance of the heat sensitive recording material exceeded 3 km, which is supposed to be attributable to the disconnection of thermal head resistor elements.

EXAMPLE 3

A heat sensitive recording material was manufactured and a running test was conducted for the heat sensitive recording material in the same manner as in Example 1 except for using SBR having a tensile modulus of elasticity of $2\times10^8$ dyne/cm$^2$ for the intermediate layer. As a result, non-recorded area was formed when the running distance of the heat sensitive recording material exceeded 7 km, which is supposed to be attributable to the disconnection of thermal head resistor elements.

Comparative Example 1

A heat sensitive recording material was manufactured and a running test was conducted for the heat sensitive recording material in the same manner as in Example 1 except for using polypropylene having a tensile modulus of elasticity of $2\times10^{10}$ dyne/cm$^2$ for the intermediate layer. As a result, non-recorded area was formed when the running distance of the heat sensitive recording material exceeded 2 km, which is supposed to be attributable to the disconnection of thermal head resistor elements. Further, contamination of the head probably attributable to the sticking of the heat sensitive recording layer to the thermal head was severer than that in Example 2.

Comparative Example 2

A heat sensitive recording material was manufactured and a running test was conducted for the heat sensitive recording material in the same manner as in Example 1 except for using SBR having a tensile modulus of elasticity of $9\times10^7$ dyne/cm$^2$ for the intermediate layer. As a result, an evenness in the recording permeation density occurred in which recording density was lost locally depending on places.

Comparative Example 3

After applying corona discharge treatment to the surface of a polyethylene terephthalate (PET) film as a support having a thickness of 175 μm and a tensile modulus of elasticity of $4\times10^{10}$ dyne/cm$^2$, a heat sensitive recording layer and a protection layer were formed thereon in the same manner as in Example 1, to manufacture a heat sensitive recording material.

A recording running test was conducted for the thus obtained heat sensitive recording material in the same manner as in Example 1. As a result, non-recorded area was formed where the running distance of the heat sensitive recording material exceeded 1.5 km, that was shorter than the distance in Example 1, and which is supposed to be attributable to the disconnection of thermal head resistor elements. The head contamination probably caused by sticking of the heat sensitive recording layer to the thermal head was severer than that in Example 1.

What is claimed is:

1. A heat sensitive recording material having a heat sensitive recording layer disposed on a support, wherein an intermediate layer having a tensile modulus of elasticity of from $1\times10^8$ to $1\times10^{10}$ (dyne/cm$^2$) as measured according to JIS K 7127 is disposed between the support and the heat sensitive recording layer.

2. A heat sensitive recording material according to claim 1, wherein the intermediate layer is formed of a polyolefin resin.

3. A heat sensitive recording material according to claim 1, wherein the intermediate layer is formed of a homopolymer or a copolymer of α-olefin.

4. A heat sensitive recording material according to claim 1, wherein the intermediate layer is coated on the support by melt extrusion coating.

5. A heat sensitive recording material according to claim 1, wherein a surface of the intermediate layer is subjected to an activating treatment.

6. A heat sensitive recording material according to claim 1, wherein the thickness of the intermediate layer is from 10 to 100 μm.

7. A heat sensitive recording material according to claim 1, wherein the tensile modulus of elasticity of the intermediate layer is less than the tensile modulus of elasticity of the support.

8. A heat sensitive recording material according to claim 1, wherein the support is a film of a resin selected from the group consisting of polyethylene terephthalate, polyethylene naphthalate, polybutylene terephthalate, cellulose triacetate, polypropylene, polystyrene, polyethylene, polyvinylidene chloride, polyacrylate and polycarbonate.

9. A heat sensitive recording material according to claim 1, wherein the thickness of the support is from 25 to 300 μm.

10. A heat sensitive recording material according to claim 1, wherein the support is a transparent support.

11. A heat sensitive recording material according to claim 1, wherein a surface of the support is subjected subjected to an activating treatment.

12. A heat sensitive recording material according to claim 1, wherein the heat sensitive recording layer contains an encapsulated color coupler or color developer.

13. A heat sensitive recording material according to claim 1, wherein the heat sensitive recording layer contains 2-aryl amino-3-(H, halogen, alkyl or alkoxy)-6-substituted aminofluoran as a color coupler.

14. A heat sensitive recording material according to claim 1, wherein the heat sensitive recording layer contains bisphenols as a color developer.

* * * * *